US006800052B1

(12) United States Patent
Abe

(10) Patent No.: US 6,800,052 B1
(45) Date of Patent: Oct. 5, 2004

(54) CORRUGATING MACHINE AND CORRUGATING ROLL DESIGN FOR THE SAME

(75) Inventor: Etsuro Abe, Komaki (JP)

(73) Assignee: Kabushiki Kaisha Isowa, Aichi-ken (JP)

( * ) Notice: Subject to any disclaimer, the term of this patent is extended or adjusted under 35 U.S.C. 154(b) by 124 days.

(21) Appl. No.: 09/636,145

(22) Filed: Aug. 10, 2000

(30) Foreign Application Priority Data

Aug. 12, 1999 (JP) ..... 11-228410

(51) Int. Cl.[7] ..... B31F 1/20

(52) U.S. Cl. ..... 493/463; 493/465; 493/427; 493/434; 492/36; 492/34

(58) Field of Search ..... 493/344, 463, 493/464, 462, 465, 427, 434, 454; 425/369, 336; 492/31, 33, 34, 36

(56) References Cited

U.S. PATENT DOCUMENTS

| | | | | | |
|---|---|---|---|---|---|
| 211,566 | A | * | 1/1879 | Gwathney | 19/37 |
| 328,639 | A | * | 10/1885 | Beale | 100/176 |
| 937,601 | A | * | 10/1909 | Heupel | 131/322 |
| 2,434,820 | A | * | 1/1948 | Tifft | 139/296 |
| 2,578,916 | A | * | 12/1951 | Belleville | 601/125 |
| 3,053,309 | A | | 9/1962 | Wilson et al. | |
| 3,419,937 | A | * | 1/1969 | Bally | |
| 4,207,998 | A | * | 6/1980 | Schmid | 226/95 |
| 4,699,031 | A | * | 10/1987 | Angelo et al. | 493/463 |
| 5,096,407 | A | | 3/1992 | Nebeling | |
| 5,419,796 | A | * | 5/1995 | Miller | 493/463 |
| 5,443,379 | A | * | 8/1995 | Hsu et al. | 425/336 |
| 5,626,709 | A | | 5/1997 | Keeny | |

FOREIGN PATENT DOCUMENTS

| | | |
|---|---|---|
| EP | 0 872 333 | 10/1998 |

* cited by examiner

*Primary Examiner*—Eugene Kim
*Assistant Examiner*—Sameh H. Tawfik
(74) *Attorney, Agent, or Firm*—Stroock & Stroock & Lavan LLP

(57) ABSTRACT

A corrugating roll design for a corrugating machine including a pair of parallel, spaced apart, corrugating rolls which rotate in opposite directions on their respective rotational axes, the rotational axes being spaced apart a predetermined distance, and each of the corrugating rolls being formed along its outer peripheral surface with longitudinally extending teeth with tooth tips and tooth roots. Depressions are provided in the tops of the tooth tips of at least one of the corrugating rolls and spaced apart a predetermined distance along the length of the roll. Each of the depressions has a bottom surface which is located to establish a spacing between the bottom surface of the depression and the tooth root of the other corrugating roll at the actual corrugation impression zone in the nip, which spacing is greater than the thickness of the paper medium.

8 Claims, 7 Drawing Sheets

CORRUGATING MACHINE AND CORRUGATING ROLL DESIGN FOR THE SAME

BACKGROUND OF THE INVENTION

The present invention relates to a corrugating machine utilized in the manufacture of corrugated cardboards or paperboards and a corrugating roll design for use with the machine.

An example of a conventional "single facer" corrugating machine for making a single faced corrugated cardboard is generally shown at 100 in FIG. 5. The single facer 100 generally comprises corrugating rolls consisting of a pair of upper and lower, counter-rotating, longitudinally toothed, corrugating rolls 110*a* and 110*b* for providing corrugations or flutes in a paper medium, or core A in a nip 160 created between the rolls 110*a* and 110*b*, a gluing section 120 for applying glue or adhesive to the tops of the flutes of the corrugated medium A as it is moved therepast, and a smooth surfaced pressure roll 130 disposed downstream of the gluing section for cooperating with the lower toothed roll 110*b* to bond the glued corrugated paper medium A and a paper liner B to each other to form a single faced corrugated cardboard product C. Each of the upper and lower corrugating rolls 110*a* and 110*b* has a tooth profile 140 defined by a plurality of tooth roots or bottom lands and a plurality of tooth tips extending longitudinally along the outer peripheral surface of the roll. Suction device 150 is disposed adjacent to the lower corrugating roll 110*b* to hold the corrugated medium A against the lower toothed roll 110*b* by suction.

In the conventional corrugating process using the single facer 100, a paper medium web is passed into the nip 160 formed by the inter-engaging teeth of the two corrugating rolls 110*a* and 110*b*, and this web begins to be deformed as it moves into an actual corrugating impression zone P in the nip where full engagement of the teeth takes place, i.e., one of the tooth tips of the upper roll 110*a* and the corresponding one of tooth roots of the lower roll 110*b* are in registration or in impression engagement. At the corrugating impression zone P, the medium web is formed into a final corrugated configuration as shown in FIG. 6. The corrugated medium A, after passing through the nip, is transferred to a glue applicator roll 170 of the gluing section 120 while being held by suction or vacuum against the lower corrugating roll 110*b*. Such transfer of the corrugated medium web can be accomplished by rotation of the lower corrugating roll 110*b*. The gluing section 120 picks up the glue contained in a glue reservoir 190 while rotating within the reservoir to be partially immersed in the glue therein, and applies the glue to the tops of the corrugations of the paper medium A. Doctor roll 180 is used to perform glue layer thickness control and provide for the application of a uniform glue layer to the tops of the corrugations of the medium A. The glued medium A is next passed between the lower corrugating roll 110*b* and the pressure roll 130 along with the liner B being carried around a portion of the pressure roll 130. The pressure roll 130 presses the glued corrugated medium A and the liner B against the lower corrugating roll 110*b* to bond the materials A and B to each other and thus produce a single faced corrugated cardboard paper product C.

The conventional design of the single facer 100 has the following disadvantages when used in the manufacture of the single faced corrugated cardboards.

Firstly, in order to ensure that the paper medium can be formed with the industrial standard type flutes and to prevent spring back of the fluted paper medium after it leaves the corrugating nip, it is required to provide a significant corrugating nip pressure between the pair of the corrugating rolls 110*a* and 110*b* at the corrugating impression zone P, the amount of which pressure is determined in accordance with a given center-to-center distance of the upper and lower corrugating rolls 110*a* and 110*b*. More specifically, the medium web can be clamped by the substantial corrugating nip pressure provided between one of the tooth tips 152 of the upper corrugating roll 110*a* and one of tooth roots 151 of the lower corrugating roll 110*b*, as shown in FIG. 7.

Paper tensile strength may depend mainly on frictional forces acting among the fibers of the paper medium and a degree of fiber entanglement. The fibers in the paper medium tend to be generally oriented in a direction perpendicular to the length of the roll as the paper medium moves through the corrugating nip. Application of substantial nip load to the medium at the corrugating nip position P may cause some of the fibers in the portion of the medium being corrugated to be cut, thereby resulting in a decrease of the degree of fiber entanglement. This may lead to a reduction strength or rupture of the corrugated paper medium and a decrease in the quality of the product.

Secondly, in order to handle a higher corrugating speed, the liner B is brought into contact with only the tops of the glued flutes of the paper medium A between the lower corrugating roll 110*b* and the pressure roll 130. In this case, the glue cannot fully penetrate into both of the medium A and the liner B. Thus, bonding may occur at interfaces between the liner B and the tops of the flutes of the medium A in which some of the fibers therein may be cut undesirably, thus resulting in reduction of the bonding strength and also reduction of the strength of the single faced corrugated cardboard product in the form of a trussed structure composed of the combined corrugated medium A and liner B.

To overcome the second disadvantage, Japanese Laid Open Patent Applicatio. No. 8-25531 proposes a pair of upper and lower corrugating rolls for a single facer wherein the corrugating rolls, instead of each having a tooth profile composed of a single arc, each have a profile of a tooth tip portion defined by a combination of a plurality of arcs that are symmetrical with respect to its center line. The tooth tip portion of each of the corrugating roll has a gentle arc form that has no abrupt change in curvature. With this arrangement, a substantially uniform distribution of contact pressure exerted on the liner and paper medium webs can be accomplished as they are compressed between the pressure roll and the lower corrugating roll.

As can be appreciated, however, the pressure roll has a smooth cylindrical surface whereas the lower and upper corrugating rolls have their tooth profiles. Accordingly, application of the teachings of the 8-25531 application to the pair of upper and lower corrugating rolls defining the corrugating nip therebetween would not prevent the loss of the strength of the paper corrugated medium because of the cut fibers mentioned above with regard to said second disadvantage. Moreover, modification of the corrugating roll design having the tooth profile composed of a single arc into that having the tooth profile defined by the combination of the plurality of arcs mentioned above may require delicate machining operations.

Also, for overcoming the problem as described in connection with the high corrugating speed, Japanese Laid Open Patent Application No. 6-23884 discloses a single facer machine wherein a liner web can be bond to a corrugated paper medium web under a reduced contact pressure in a nip formed by lower corrugating and pressure rolls. In the single facer of the 6-23884 application, the liner contacts the glued flute tips of the corrugated medium in the pressure nip formed by the pressure roll and the lower corrugating roll, with the liner web being tensioned by means of tensioning rolls disposed upstream and downstream of the lower corrugating roll in order to reduce the substantial contact pressure which would be otherwise required at the pressure nip.

However, it is not practical to apply the teachings of the 6-23884 application to the pair of upper and lower corrugating rolls defining the corrugating nip because high corrugating nip pressure is required at the nip defined between the upper and lower corrugating rolls whereas relatively low contact pressure is applied at the pressure nip between the lower corrugating roll and the pressure roll so as to provide an initial bond between the corrugated paper medium and the liner webs.

In practice, it is difficult to apply the teachings of the 6-23884 application to the upper pair of and lower corrugating rolls.

SUMMARY OF THE INVENTION

In view of the above-mentioned problem encountered with a corrugating nip formed by upper and lower corrugating rolls, it is an object of the invention to provide a corrugation roll design for a corrugating machine which prevents failure of the fibers in a paper medium web when it is corrugated, thereby maintaining the required strength of the paper medium.

Also, in view of the above-mentioned problem encountered with a pressure nip formed by lower corrugating and pressure rolls, it is another object of the invention to provide a corrugating machine wherein a paper liner web is combined with glued flute tops of the paper medium in which the fibers therein are not cut, thereby preventing, loss of strength of the corrugated cardboard.

Furthermore, it is another object of the invention to cost-effectively modify or retrofit the existing corrugating rolls in a manner so as to prevent the loss of the strength of the corrugated cardboard.

In order to attain these and other objects, the present invention provides a corrugating roll design for a corrugating machine comprising a pair of parallel, spaced apart, corrugating rolls which rotate in opposite directions on their respective rotational axes, the rotational axes of the corrugating rolls being spaced apart a predetermined distance, and each of the corrugating rolls being formed along its outer peripheral surface with longitudinally extending teeth with tooth tips and tooth roots, a paper medium to be corrugated adapted to be fed into a nip formed by the teeth of the corrugating rolls inter-engaging, and begin to be deformed as it moves into an actual corrugating impression zone in the nip where full engagement of the teeth takes place, thereby providing corrugations in the paper medium, characterized by depressions provided in the tops of the tooth tips of at least one of the corrugating rolls and spaced apart a predetermined distance along the length of the roll, each of said depressions having a bottom surface which is located to establish a spacing between the bottom surface of the depression and the tooth root of the other corrugating roll at the actual corrugation impression zone in the nip, the above mentioned spacing being greater than the thickness of the medium.

According to one feature of the invention, the ratio of the sum total of the axial lengths of the depressions to the transverse dimension of the paper medium measured longitudinally of the above mentioned at least one of the corrugating roll is greater than a predetermined value.

Preferably, the bottom surface of each of the depressions is of a generally convex arc configuration in a direction toward the other corrugating roll with a radius of curvature greater than that of the tooth tips of said at least one of the corrugating rolls in a plane generally perpendicular to the longitudinal direction of the roll.

According to another feature of the invention, each of the depressions can be provided at its opposite sides with ramps extending in a divergent fashion from the bottom surface thereof to the top of the tooth tip of the above mentioned at least one of the corrugating rolls.

It is preferable for each of the tooth profiles of the corrugating rolls to be comprised of a combination of a plurality of arcs that are symmetrical with respect to a center line of the tooth tip, i.e., a line connecting the apex of the tooth tip and the rotational axis of the corrugating roll.

According to another feature of the invention, the depressions of adjacent teeth or tooth tips of the above mentioned at least one of the corrugating rolls are offset from one another along the length of the corrugating roll.

Preferably, the depressions are disposed in a helical pattern along the peripheral surface of the corrugating roll.

The present invention also provides a corrugating machine comprising the pair of corrugating rolls as defined above, the corrugating rolls cooperating to provide a corrugated paper medium, gluing means for applying glue to the flute tops of the corrugated medium, and pressure means disposed downstream of the gluing means for cooperating with one of the corrugating rolls to compress the corrugated medium and a liner therebetween to bond them.

The present invention also provides a double facer comprising a pair of parallel, spaced apart, corrugating rolls which rotate in opposite directions on their respective rotational axes, the rotational axes of the corrugating rolls being spaced apart a predetermined distance, and each of the corrugating rolls being formed along its outer peripheral surface with longitudinally extending teeth with tooth tips and tooth roots, a paper medium to be corrugated adapted to be fed into a nip formed by the teeth of the corrugating rolls inter-engaging, and begin to be deformed as it moves into an actual corrugating impression zone in the nip where full engagement of the teeth takes place, thereby providing corrugations in the medium, each of said corrugating rolls having depressions provided in the tops of the tooth tips thereof and spaced apart a predetermined distance along the length of the roll, each of the depressions having a bottom surface which is located to establish a spacing between the bottom surface of the depression and the tooth root of the other corrugating roll at the actual corrugation impression zone in the nip, the above mentioned spacing being greater than the thickness of the paper medium; first gluing means for applying glue to the flute tops of one of faces of the corrugated medium; first pressure means disposed downstream of the first gluing means for cooperating with the one of the corrugating rolls to compress the glued flute tops of the one face of the corrugated paper medium and a first liner therebetween to bond them; second gluing means disposed downstream of the first pressure means for applying glue or adhesive to the flute tops of the other face of the paper medium; and bonding means disposed downstream of the second gluing means for bonding a second liner web to the glued flute tops of the other face of the corrugated medium.

In an operation of the corrugating rolls according to the invention, a paper medium web is fed into the nip between the inter-engaging teeth of the upper and lower corrugating rolls rotating in opposite directions. The medium web begins to be deformed or folded as it moves into the corrugating impression zone in the nip where it is formed with corrugations or flutes.

More specifically, the upper and lower corrugating rolls are disposed parallel to each other at a predetermined center-to-center spacing. At the impression zone, the paper medium web is clamped or pinched between one of the tooth tips of one of the corrugating rolls and one of the tooth roots of the other corrugating roll at the impression zone under a predetermined nip load and thus is formed into its final fluted or corrugated configuration without any spring back occurring.

In view of that fact that depressions are provided in the tops of the tooth tips of at least one of the corrugating rolls and spaced apart a predetermined distance along the length of the roll, at the corrugating impression zone, some areas where the paper medium web is sandwiched between one of the tooth tips of one of the corrugating rolls and one of the tooth roots of the other corrugating roll as well as other areas where the paper medium web is sandwiched between the depressions on one of the tooth tips of one of the corrugating rolls and one of the tooth roots of the other corrugating roll are scattered along the length of the roll.

Since, as has already been stated, each depression of one of the corrugating rolls has a bottom surface which is located to establish a spacing between the bottom surface of the depression and one of the tooth roots of the other corrugating roll at the impression zone, substantially no corrugating nip pressure is exerted on the paper medium at said some areas, thereby preventing failure of the fibers in the paper medium web while at the same time, sufficient corrugating nip load is imposed on the paper medium web at said other areas.

The corrugated cardboard making machine having the corrugating rolls constructed in accordance with the invention prevents failure or cutting of the fibers in the paper medium during corrugating impression. As a result, the required strength of the medium web can be maintained. In addition, since the liner is combined with the glued paper medium in which the fibers remain intact by pressure means through the bonding of the surface of the liner with that of the paper medium, the required strength of the finished corrugated cardboard can be maintained.

DETAILED DESCRIPTION OF THE PREFERRED EMBODIMENTS

One embodiment of the invention will now be described with reference to FIGS. 1 to 4 of the accompanying drawings in conjunction with, for example, a "single facer" corrugating machine for making a single faced corrugated cardboard or paperboard.

Figure 5:
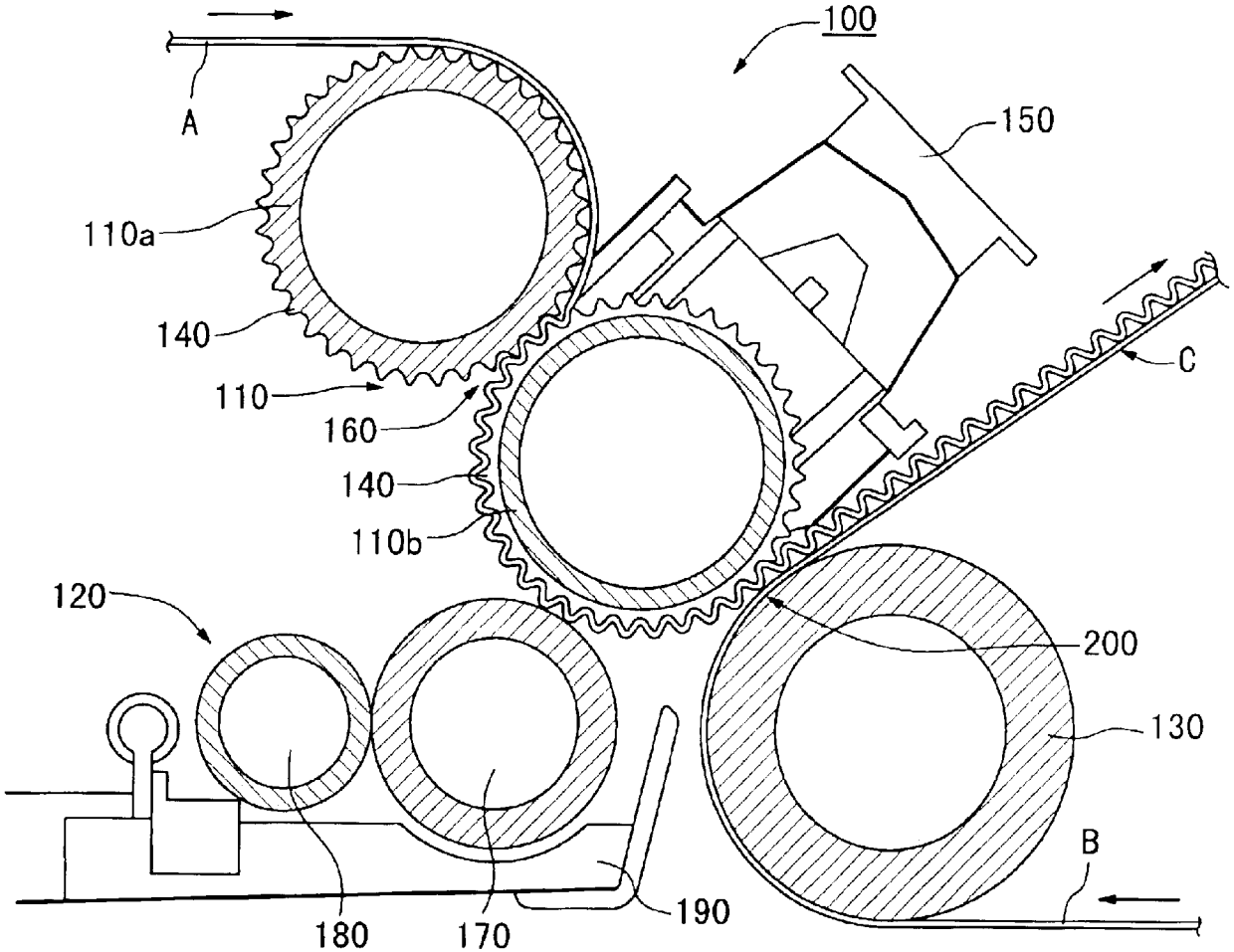
FIG. 5 (PRIOR ART)
FIG. 5 is a sectional view in schematic form of a conventional single facer.
Figure 6:
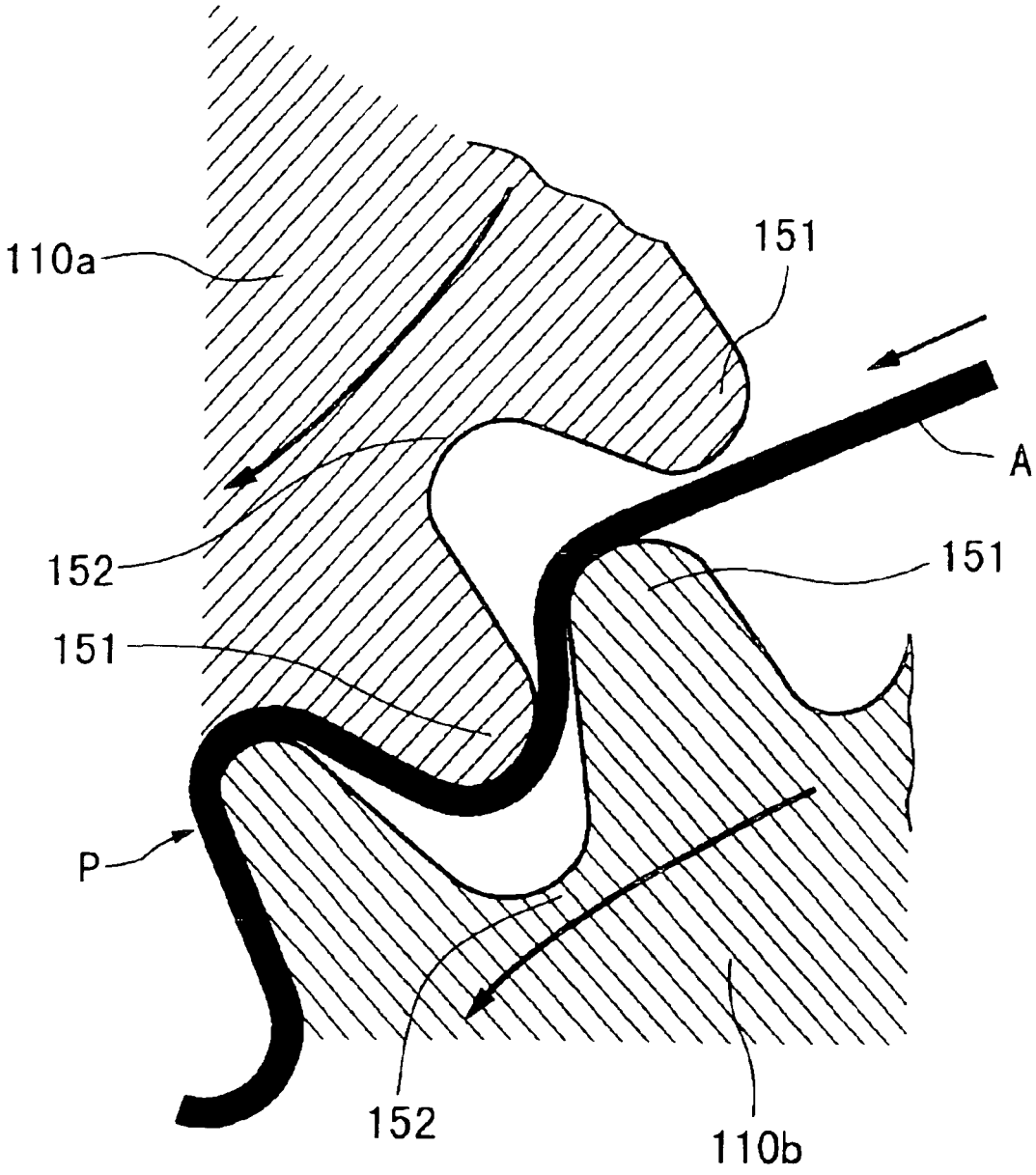
FIG. 6 (PRIOR ART)
FIG. 6 is an enlarged fragmentary view at the point where the teeth of the corrugating rolls intermesh.
Figure 7:
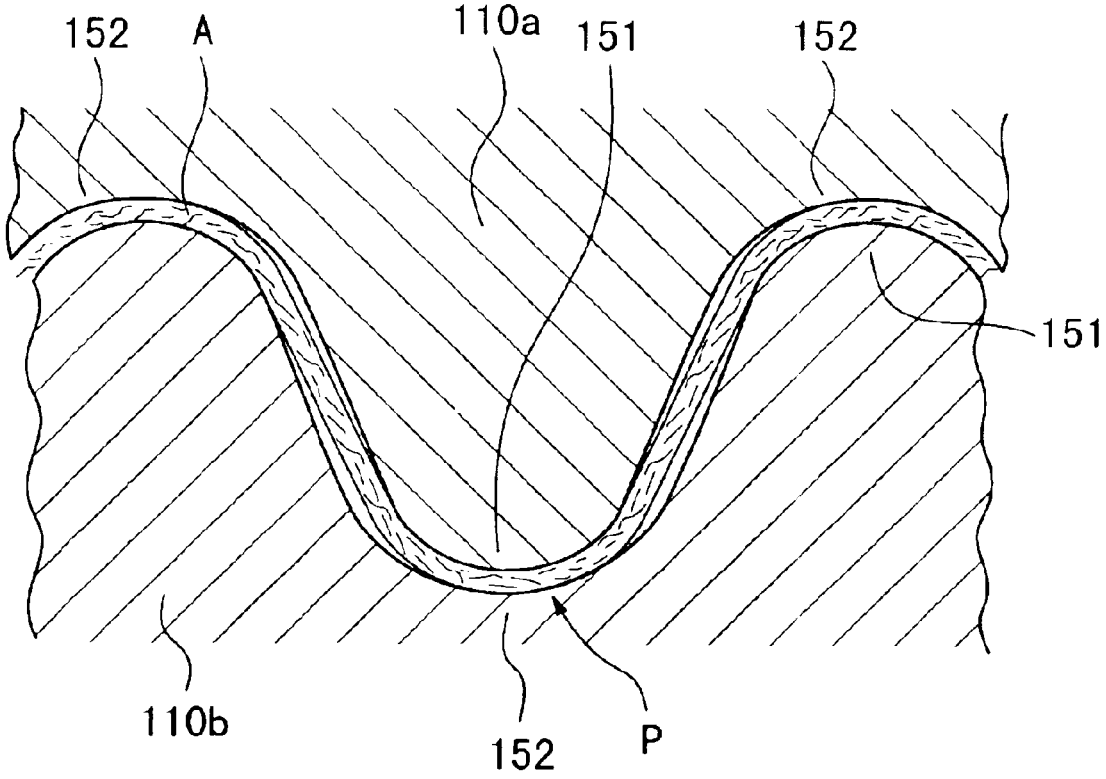
FIG. 7 (PRIOR ART)
FIG. 7 is a view similar to FIG. 3 showing the geometric relationship between the tooth tips and the tooth roots of two conventional corrugating rolls.

The single facer 10 generally comprises a pair of corrugating rolls 12 for providing corrugations or flutes in a paper medium web A, a glue applicator (not shown in FIG. 1) for applying glue or adhesive to the tips of the corrugations of the medium A, and a pressure roll (not shown in FIG. 1) disposed downstream of the glue applicator for cooperating with one of the rolls to compress the corrugated medium web and a liner web therebetween to bond them and thus form a single faced corrugated cardboard product. The components of the single facer according to the invention are identical to those of the conventional single facer as shown in FIG. 5 except for the design of the corrugating rolls 12 and thus require no further description thereof. Accordingly, the description given hereinafter will focus on the corrugating rolls 12.

Figure 1:
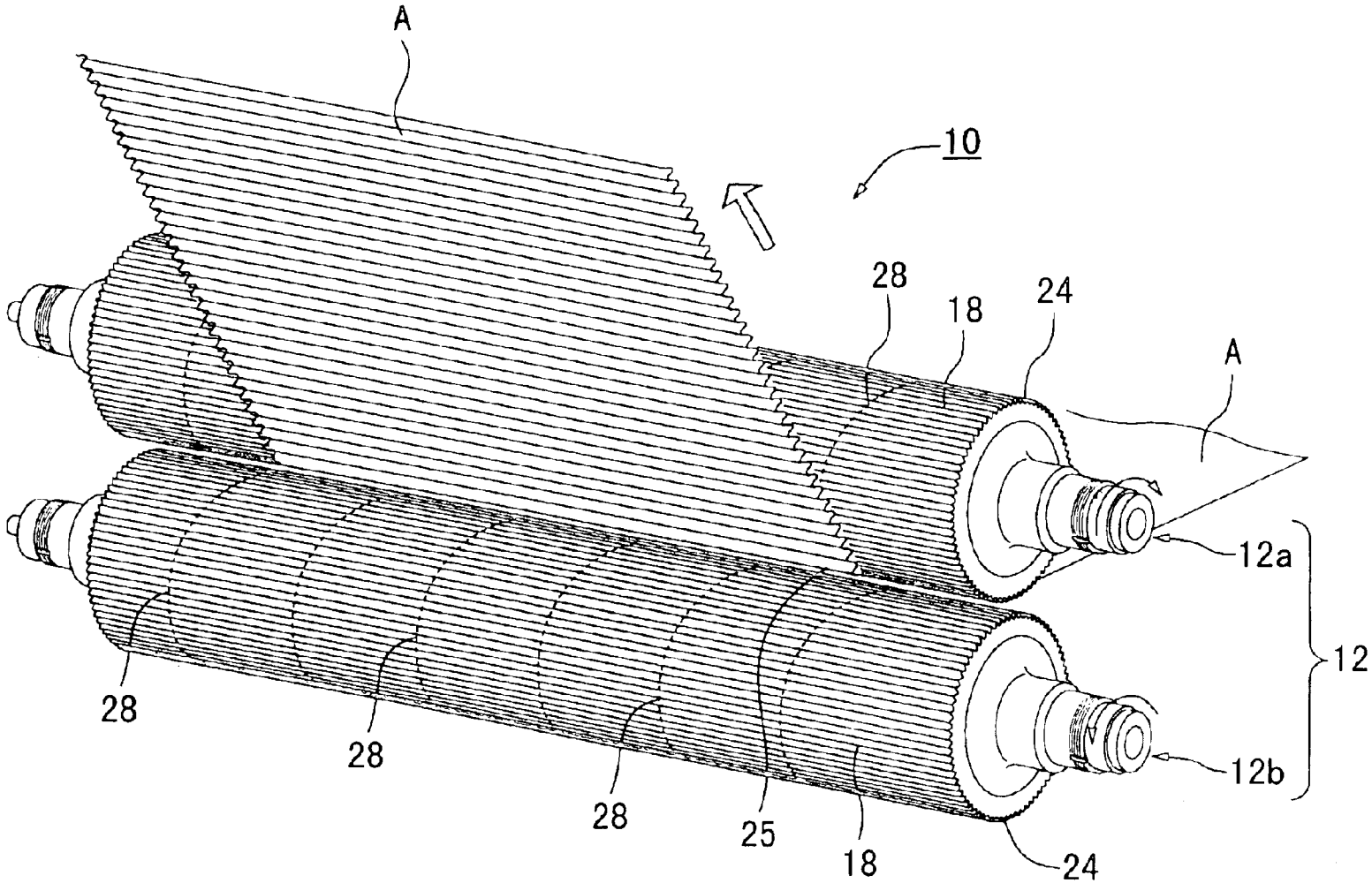
FIG. 1 is a partial perspective view of a corrugating machine in accordance with one embodiment of the present invention, showing a paper medium web being corrugated by a pair of corrugating rolls.

As shown in FIG. 1, the corrugating rolls 12 consist of upper and lower corrugating rolls 12*a* and 12*b*. The rolls 12*a* and 12*b* are disposed parallel to each other at a predetermined center-to-center spacing and rotate in opposite directions about their respective rotational axes as shown by an arrow in FIG. 1. Each of the upper and lower corrugating rolls 12*a* and 12*b* has a tooth profile 24 defined by a plurality of tooth roots and tooth tips 20 and 22, respectively, which extend longitudinally along an outer peripheral surface 18 of the roll. The tooth profile 24 can be of any conventional shape, for example, in the form of involute curves. In this case, the number of teeth, circular pitch, whole depth module etc. can be selected as necessary to meet customer needs. It is preferable that each tooth profile 24 be composed of a combination of a plurality of arcs that are symmetrical with respect to a center line 1 of the tooth profile, i.e., a line connecting the apex of the tooth tip 22 and the rotational axis of the corresponding corrugating roll. A paper medium web A to be corrugated is fed into a nip 25 formed by the inter-engaging teeth 24 of the corrugating rolls 12*a* and 12*b*, and begins to be deformed as it is moved into an actual corrugating impression zone P in the nip where full engagement of the teeth takes place, thereby providing corrugations in the medium.

Figure 2:
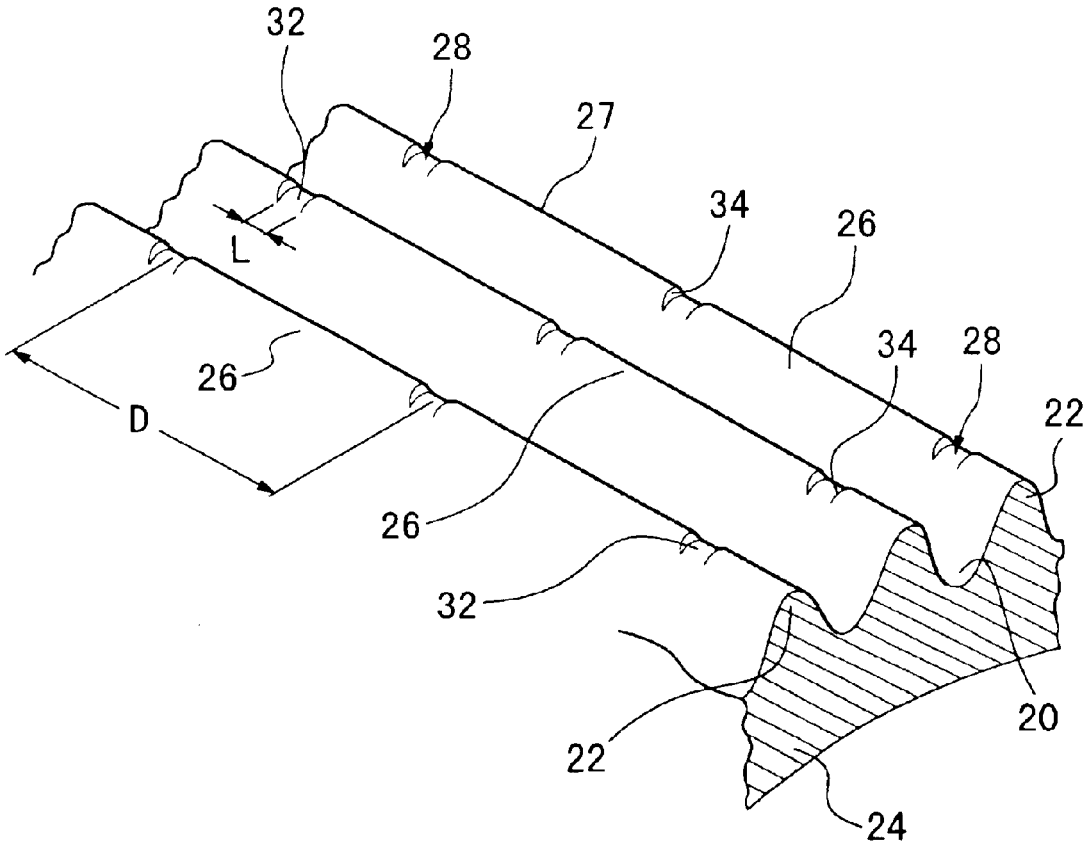
FIG. 2 is a partial perspective view of a corrugating roll design according to the present invention.
Figure 3:
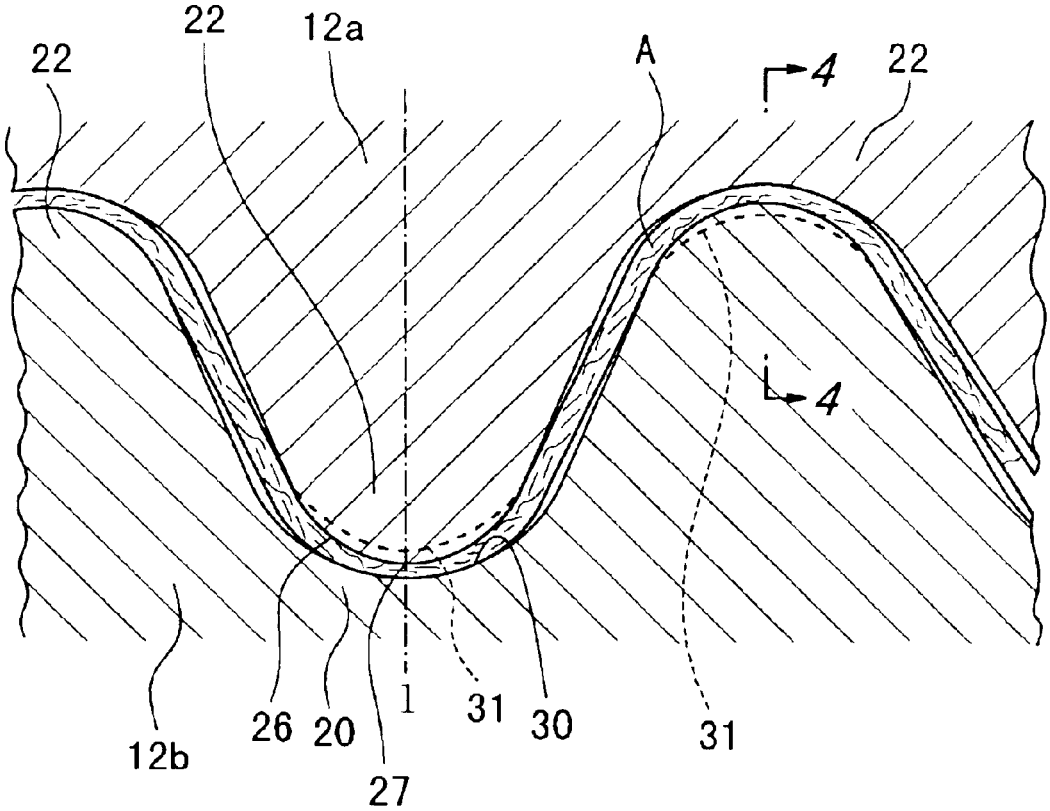
FIG. 3 is a schematic representation of tooth tips and tooth roots of the two corrugating rolls of the invention with the corrugated paper medium web interposed therebetween.

As shown in FIGS. 2 and 3, one of the corrugating rolls, for example, the roll 12*a* has a series of depressions 28 provided in tops 26 of the tooth tips 22 thereof and spaced apart a predetermined distance D along the length of the roll. Each of the depressions 28 has a bottom surface 32 which is located to establish a spacing between the bottom surface 32 of the depression and a bottom surface 30 of the tooth root 20 of the other corrugating roll 12*b* at the actual corrugation impression zone P in the nip, which spacing is greater that the thickness of the medium web A. The ratio of the sum total of the axial lengths of the depressions 28 to the transverse dimension or width of the medium web A measured longitudinally of the roll may be greater than a predetermined value.

As clearly shown in FIG. 3, in a plane generally perpendicular to the longitudinal direction of the roll, the bottom surface 32 of each of the depressions 28 is of generally convex arc configuration as indicated at 31 in a direction toward the other corrugating roll 12*b*, and has a radius of curvature greater than that of the tooth tips 22 of the corrugating roll 12*a*. The configuration of each bottom surface 32 is such that it substantially follows the corrugated contour of the paper medium between the top 26 of one of the tooth tips 22 of the corrugating roll 12*a* and the bottom 30 of one of the tooth roots 20 of the roll 12*b* at the corrugating impression zone P. Due to this, the medium being corrugated is positively prevented from being damaged or ruptured as a result of the medium being pressed between the top 26 of the tooth tip 22 of the roll 12*a* and the bottom 30 of the tooth root 20 of the roll 12*b* at the impression zone P.

Figure 4:
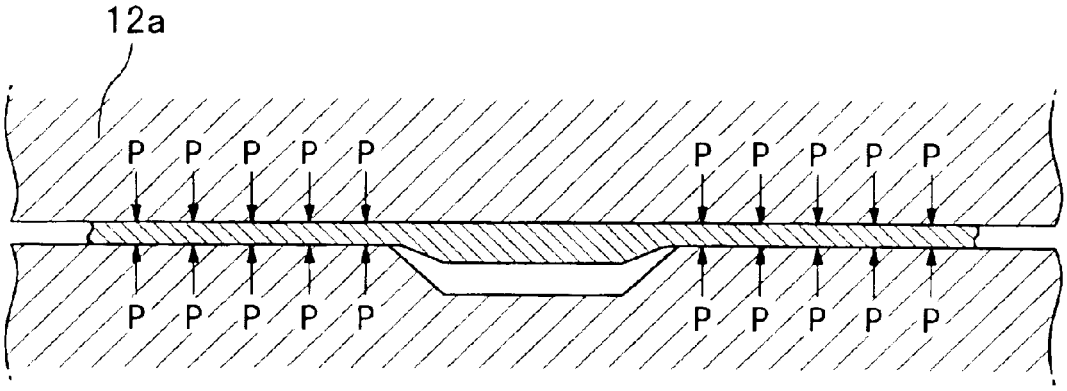
FIG. 4 is a partial cross-sectional view taken in the direction of line 4—4 of FIG. 3.

As can be clearly seen in FIG. 4, each of the depressions 28 can be provided at its opposite sides with ramps 34 extending in a divergent fashion from the bottom surface 32 to the top 26 of the tooth tip of the corrugating roll 12*a*. The radius of curvature and depth of the bottom surface, and the spacing D between the depressions can be selected depending on various impression conditions and the type of the paper medium.

It should be noted that the depressions of adjacent tooth tips 22 of the corrugating roll 12*a* are offset from one another along the length of the corrugating roll and disposed in a helical pattern along the peripheral surface of the corrugating roll, as indicated in FIG. 1. As a result, advantageously, the corrugated medium web A has distributed across the width thereof portions that are not subject to the corrugating impression load and thus in which the fibers are not cut.

Before giving a description of the corrugating process performed by use of the corrugating machine according to the invention, it is believed that it is advisable to explain the manner by which the existing corrugating rolls may be modified in accordance with the teachings of the invention.

Firstly, the existing corrugating roll can be formed with a series of depressions 28 in the tooth tips of the corrugations thereof, as can be seen in FIG. 1. To do this, a suitable cutting tool can be selected depending on the desired cross sectional configuration of the depressions. With the cutting tool engaging one of the corrugation tooth tips of the roll, the roll can be rotated about its axis to form a first depression in the tip. Then, the cutting tool is translated longitudinally a suitable distance corresponding to the desired axial offset. Then, the further rotation of the roll allows the cutting tool to cut a tooth tip adjacent to the already cut tooth tip to form a second depression which is offset from the first depression. Repetition of such an operation will provide depressions having a helical pattern in the existing corrugating roll in a less time-consuming manner. Alternatively, mutually spaced arrays of the depressions can be provided circumferentially around the peripheral surface of the roll. In this case, a plurality of spaced apart cutting tools can be used. With the cutting tools engaging one of the tooth tips of the roll, the roll can be rotated, thus resulting in the formation of the parallel arrays of the depressions in a short time.

In the corrugating process, a paper medium A is fed into the nip 25 between the inter-engaging teeth of the counter-rotating upper and lower corrugating rolls 12*a* and 12*b* and begins to be deformed or folded as it moves into the corrugating impression zone P in the nip where it is pinched between the tooth tips 22 and the tooth roots 20 to be formed into a final corrugated configuration as shown in FIG. 1.

More specifically, the upper and lower corrugating rolls 12*a* and 12*b* are disposed parallel to each other at a predetermined center-to-center spacing. At the impression zone P, the medium A is clamped between one of the tooth tips 22 of one of the corrugating rolls and one of the tooth roots 20 of the other corrugating roll under the predetermined nip pressure and thus is formed into its final corrugated configuration without any resulting spring back occurring.

In view of the above fact that depressions 28 are provided in the tops 26 of the tooth tips 22 of one of the corrugating rolls 12 and spaced apart the predetermined distance along the length of the roll, at the corrugating impression zone P, some areas where the paper medium web is sandwiched between one of the tooth tips of one of the corrugating rolls and one of the tooth roots of the other corrugating roll as well as other are as where the paper medium web is sandwiched between the depressions on one of the tooth tips of one of the corrugating rolls and one of the tooth roots of the other corrugating roll are scattered along the length of the roll.

Since, as has already been stated, each depression 28 of one of the corrugating rolls has a bottom surface 32 which is located to establish a spacing between the bottom surface 32 of the depression and the tooth root 20 of the other corrugating roll at the impression zone P, substantially no corrugating nip pressure is exerted on the paper medium A at some area where the paper medium web is sandwiched between the depressions on one of the tooth tips of one of the corrugating rolls and one of the tooth roots of the other corrugating roll, thereby preventing failure of the fibers in the paper medium web while at the same time, sufficient corrugating nip load is imposed on the paper medium web A at other areas where the paper medium web is sandwiched between one of the tooth tips of one of the corrugating rolls and one of the tooth roots of the other corrugating roll. It also should be noted that the divergently extending ramps 34 of each of the depressions 28 which define transitions with blunt, obtuse edges between the bottom surface 32 and the top 26 of the tooth tip 22 serve to avoid damage to or possibly rupture of the paper medium web A which would otherwise be incurred.

The corrugated medium is glued by the glue applicator in the usual manner. The pressure roll cooperates with the lower corrugating roll 12*b* to bond the glued corrugated medium web A to the liner web B to produce a single faced corrugated paperboard product.

The single facer 10 having the corrugating rolls 12 constructed in accordance with the teachings of the invention prevents failure of the fibers in the paper medium A during corrugating impression. As a result, reduction of the strength of the medium web can be avoided. In addition, since the liner web is combined with the glued paper medium web having the portions in which the fibers remaining intact by pressure means through bonding of the surface of the liner to that of the paper medium, the required strength of the finished corrugated cardboard can be maintained.

While specific embodiments of the invention have been described in detail, various modifications and alternations thereto will occur to those skilled in the art within the scope of the present inventive concepts which are delineated by the following claims. More specifically, it will be understood that, while the single faced corrugated cardboard is referred to in this specification, the invention could be applied a double faced corrugated cardboard. In this case, the depressions can be provided in each roll of the pair of corrugating rolls of the single facer as shown in FIG. 1. The double faced corrugated cardboard is formed by applying glue to the face of the corrugated paper medium opposite a first liner thereon and bonding a second liner to that face of the medium. Such bonding of the second liner can be often accomplished in such a manner that the glue may penetrate into both paper the medium and the second liner. The depressions in both of the upper and lower corrugating rolls will serve to avoid reduction of the required strength of the double faced corrugated cardboard because cutting of the fibers in the tips and valleys of the corrugated paper medium can be prevented. Also, the depressions may be provided in selected tooth tips of the roll rather than all of the tooth tips. The number of depressions and the surface area of the depression bottom can be selected depending on the desired type of flute, the type of the medium, the impression conditions, etc.

As has already been stated, the use of the corrugating rolls according to the invention results in preventing failure of the fibers in a paper medium when it is corrugated, thereby maintaining the required strength of the medium.

In the corrugated cardboard making machine according to the invention, a paper liner is combined with glued flute tops of the paper medium in which the fibers therein are not cut, thereby preventing loss of the required strength of the corrugated cardboard.

Additionally, the existing corrugating rolls can be modified at a low cost so as to prevent loss of the strength of the corrugated cardboard.

What is claimed is:

1. A corrugating roll design for a corrugating machine comprising a pair of parallel, spaced apart, corrugating rolls which rotate in opposite directions on their respective rotational axes, the rotational axes of the corrugating rolls being spaced apart a predetermined distance, and each or the corrugating rolls being formed along its outer peripheral surface with longitudinally extending teeth with tooth tips and tooth roots, a paper medium to be corrugated adapted to be fed into a nip formed by the teeth of the corrugating rolls inter-engaging, and begin to be deformed as it roves into an actual corrugating impression zone in the nip where full engagement of the teeth takes place, thereby providing corrugations in the paper medium, characterized by depressions provided in the tops of the tooth tips of at least one of the corrugating rolls and spaced apart a predetermined distance along the length of the roll, each of said depressions having a bottom surface which is located to establish a spacing, between the bottom surface of the depression and the tooth root of the other corrugating roll at said actual corrugation impression zone in the nip, said spacing being greater than the thickness of the medium.

2. A corrugating roll design according to claim 1, wherein, the ratio of the sum total of the axial lengths of said depressions to the transverse dimension of the paper medium measured longitudinally of said at least one of the corrugating roll is greater than a predetermined value.

3. A corrugating roll design according to claim 1, wherein, said bottom surface of each of said depressions is of a generally convex arc configuration in a direction toward the other corrugating roll with a radius of curvature greater than that of the tooth tips of said at least one of the corrugating rolls in a plane generally perpendicular to the longitudinal direction of the roll.

4. A corrugating roll design according to claim 1, each of the depressions is provided at its opposite sides with ramps extending in a divergent fashion front the bottom surface thereof to the top of the tooth tip of said at least one of the corrugating rolls.

5. A corrugating roll design according to claim 1, each of the tooth profiles of the corrugating rolls comprising a combination of a plurality of arcs that are symmetrical with respect to a line connecting the apex of the tooth tip and the rotational axis of the corrugating roll.

6. A corrugating roll design according to claim 5, said depressions are disposed in a helical pattern along the peripheral surface of the corrugating roll.

7. A corrugating roll design according to claim 1, said depressions of adjacent tooth tips of said at least one of the corrugating rolls are offset from one another along the length of the corrugating roll.

8. A corrugating machine comprising the pair of corrugating rolls according to claim 1, said corrugating rolls cooperating to provided a corrugated paper medium, gluing means for applying glue to the flute tops of the corrugated medium, and pressure means disposed downstream of the gluing means for cooperating with one of the corrugating rolls to compress the corrugated medium and a liner therebetween to bond them.

* * * * *